US006805527B1

(12) United States Patent
Gotz

(10) Patent No.: US 6,805,527 B1
(45) Date of Patent: Oct. 19, 2004

(54) FORK LIFT TRUCK

(75) Inventor: Bernhard Gotz, Aschaffenburg (DE)

(73) Assignee: Linde Aktiengesellschaft (DE)

( * ) Notice: Subject to any disclaimer, the term of this patent is extended or adjusted under 35 U.S.C. 154(b) by 391 days.

(21) Appl. No.: 09/421,675

(22) Filed: Oct. 20, 1999

(30) Foreign Application Priority Data

Oct. 28, 1998 (DE) ..... 198 49 768

(51) Int. Cl.[7] ..... B66F 9/06

(52) U.S. Cl. ..... 414/673; 414/631; 414/914; 187/222

(58) Field of Search ..... 414/631–636, 414/673, 914; 187/222; 280/756, 187

(56) References Cited

U.S. PATENT DOCUMENTS

| | | | | | |
|---|---|---|---|---|---|
| 2,263,981 | A | * | 11/1941 | Dalecke et al. | 280/756 X |
| 2,349,352 | A | * | 5/1944 | Johnson | 187/222 X |
| 2,349,353 | A | * | 5/1944 | Johnson | 414/914 X |
| 2,506,242 | A | * | 5/1950 | Shoemaker | 414/914 X |
| 2,621,821 | A | * | 12/1952 | Melin | 414/914 X |
| 2,639,829 | A | * | 5/1953 | Dempster et al. | 414/914 X |
| 2,724,521 | A | * | 11/1955 | Squires | 414/914 X |
| 2,925,149 | A | * | 2/1960 | Hughson | 187/222 |
| 3,061,034 | A | * | 10/1962 | Hoyt | 180/68.5 |
| 3,199,699 | A | * | 8/1965 | Dayton | 414/914 X |
| 3,367,441 | A | * | 2/1968 | Schuster et al. | 180/68.5 |
| 3,730,545 | A | * | 5/1973 | Allori | 280/759 |
| 3,756,350 | A | * | 9/1973 | Gandolfo et al. | 187/222 |
| 3,787,086 | A | * | 1/1974 | Cosby | 296/65.07 |
| 3,907,140 | A | * | 9/1975 | Jinks | 414/914 X |
| 3,997,029 | A | * | 12/1976 | Evans | 414/914 X |
| 4,067,393 | A | * | 1/1978 | Szarkowski | 414/914 X |
| 4,067,415 | A | * | 1/1978 | Samide | 187/222 |
| 4,069,932 | A | * | 1/1978 | Stedman | 414/914 X |
| 4,207,967 | A | * | 6/1980 | Stedman | 187/222 X |
| 6,233,827 | B1 | * | 5/2001 | Oliver et al. | 187/222 X |

FOREIGN PATENT DOCUMENTS

| | | | | |
|---|---|---|---|---|
| JP | 52-025362 | * | 2/1977 | 187/222 |

* cited by examiner

*Primary Examiner*—Robert P. Olszewski
*Assistant Examiner*—Gerald J. O'Connor
(74) *Attorney, Agent, or Firm*—Webb Ziesenheim Logsdon Orkin & Hanson, P.C.

(57) ABSTRACT

A fork lift truck is provided with a lifting frame, a rear weight and a driver's cab. The driver's cab forms a load-bearing component of the fork lift truck, whereby there are two bearings for the lifting frame at some vertical distance from each other, by which the lifting frame is connected in a force-transmitting connection with the driver's cab. Each bearing for the lifting frame is suitable for the transmission of compression forces or tension forces. There is also a bearing for the rear weight, by which the rear weight is connected in a force-transmitting connection with the driver's cab. The bearing for the rear weight is suitable for the transmission of forces and moments.

1 Claim, 3 Drawing Sheets

FORK LIFT TRUCK

BACKGROUND OF THE INVENTION

This invention relates generally to a fork lift truck with a lifting frame, a rear weight and a driver's cab. The lifting frame, on which a load receptacle device is mounted so that it can be moved vertically, is located on the front end of the fork lift truck. On the rear end of the fork lift truck there is a rear weight that acts as a counterweight for the weight of the load receptacle and for the inertial forces of the load being lifted with the load receptacle device.

On fork lift trucks of the prior art, there is a vehicle frame between the lifting frame and the rear weight. The lifting frame is generally mounted on the vehicle frame so that it can pivot, whereby the forces and moments that are exerted on the lifting frame are supported by the vehicle frame. The vehicle frame is also rigidly connected with the rear weight. The forces that occur between the lifting frame and the rear weight are therefore transmitted via the vehicle frame. In many cases, the rear weight is a component of the vehicle frame, i.e., it is integrated into the vehicle frame. On fork lift trucks of the prior art, the driver's cab conventionally forms a separate component and is attached to the vehicle frame with damping elements. The components of the driver's cab frequently include a protective roof, and on a closed driver's cab, windows and doors. On fork lift trucks of the prior art, both the frame and the driver's cab are realized in the form of welded structures, and are complex and expensive in terms of their manufacture and transport. Therefore, it is an object of this invention to provide a simply constructed fork lift truck that can be manufactured easily and economically.

SUMMARY OF THE INVENTION

The invention teaches that the driver's cab of the industrial truck forms a load-bearing component of the, truck wherein there are preferably at least two bearings for the lifting frame that are at a substantially vertical distance from one another, by means of which the lifting frame is connected to the driver's cab in a force-transmitting connection. The forces that act on the lifting frame are transmitted at least partly via the driver's cab. These forces are absorbed directly or indirectly by the driver's cab at preferably two bearings. The driver's cab thus acts as a force-transmitting component and performs at least partly the force-transmitting function of the vehicle frame, which in the prior art is realized in the form of a separate component. This construction leads to a self-supporting structure of the fork lift truck, in which no significant load-bearing components are necessary besides the vehicle frame.

The bearings can be realized, for example, in the form of rigid connections or in the form of rocker bearings, whereby the use of rocker bearings that have one rotational degree of freedom and/or that have two rotational degrees of freedom is possible. It should be noted that in connection with this invention, two or more connections or rocker bearings oriented coaxially with one another, which are separated from one another only in the transverse direction of the fork lift truck, should be considered as belonging to a single bearing.

In one embodiment of the invention, in the vicinity of a bearing for the lifting frame, preferably in the vicinity of an upper bearing, at least one hydraulic cylinder is located between the lifting frame and the driver's cab. The hydraulic cylinder can thereby be fastened on one hand to the bearing of the driver's cab and on the other hand to the lifting frame.

The lifting frame can be tilted by changing the length of the hydraulic cylinder, i.e., by extending or retracting the piston.

Each bearing for the lifting frame is suitable for the transmission of compression forces or tension forces. For this purpose, there is at least one rocker bearing at each of these bearings. Torques that are originated from the lifting frame are absorbed by the two separated bearings of the driver's cab.

The driver's cab also has at least one bearing for the rear weight, by means of which the rear weight is connected directly or indirectly with the driver's cab. The driver's cab thus connects the rear weight with the lifting frame. The bearing for the rear weight is preferably located on an upper portion of the rear weight. The driver's cab, when realized in accordance with the invention, thus extends into the area above the rear weight. The bearing for the rear weight is appropriately designed for the transmission of forces and moments. For this purpose, the driver's cab and the rear weight can be fastened to one another by means of threaded fasteners.

The driver's cab has at least one strut that extends between the lower bearing for the lifting frame and the bearing for the rear weight. Compression and tension forces are thus transmitted directly between these two bearings by means of this strut.

The driver's cab also has a framework construction, by means of which forces can be transmitted between the upper bearing for the lifting frame and the bearing for the rear weight. Because it is necessary to make sufficient space available for the driver inside the driver's cab, no continuous linear struts can be provided in this location. Instead, the framework construction is provided for the transmission of forces.

The framework construction advantageously forms a triangle, in which a first corner of the triangle is located in the upper portion of the driver's cab, and a second and third corner of the triangle are located in the vicinity of the bearing for the rear weight. The forces that originate from the upper bearing for the lifting frame are transmitted directly or indirectly, e.g., by means of an additional strut, into the upper corner of the triangle, the two other corners of which are supported on the rear weight.

BRIEF DESCRIPTION OF THE DRAWINGS

Additional advantages and details of the invention are explained in greater detail below with reference to the exemplary embodiment that is illustrated schematically in the accompanying figures, in which like reference characters identify like parts throughout.

DESCRIPTION OF THE PREFERRED EMBODIMENT

Figure 1:
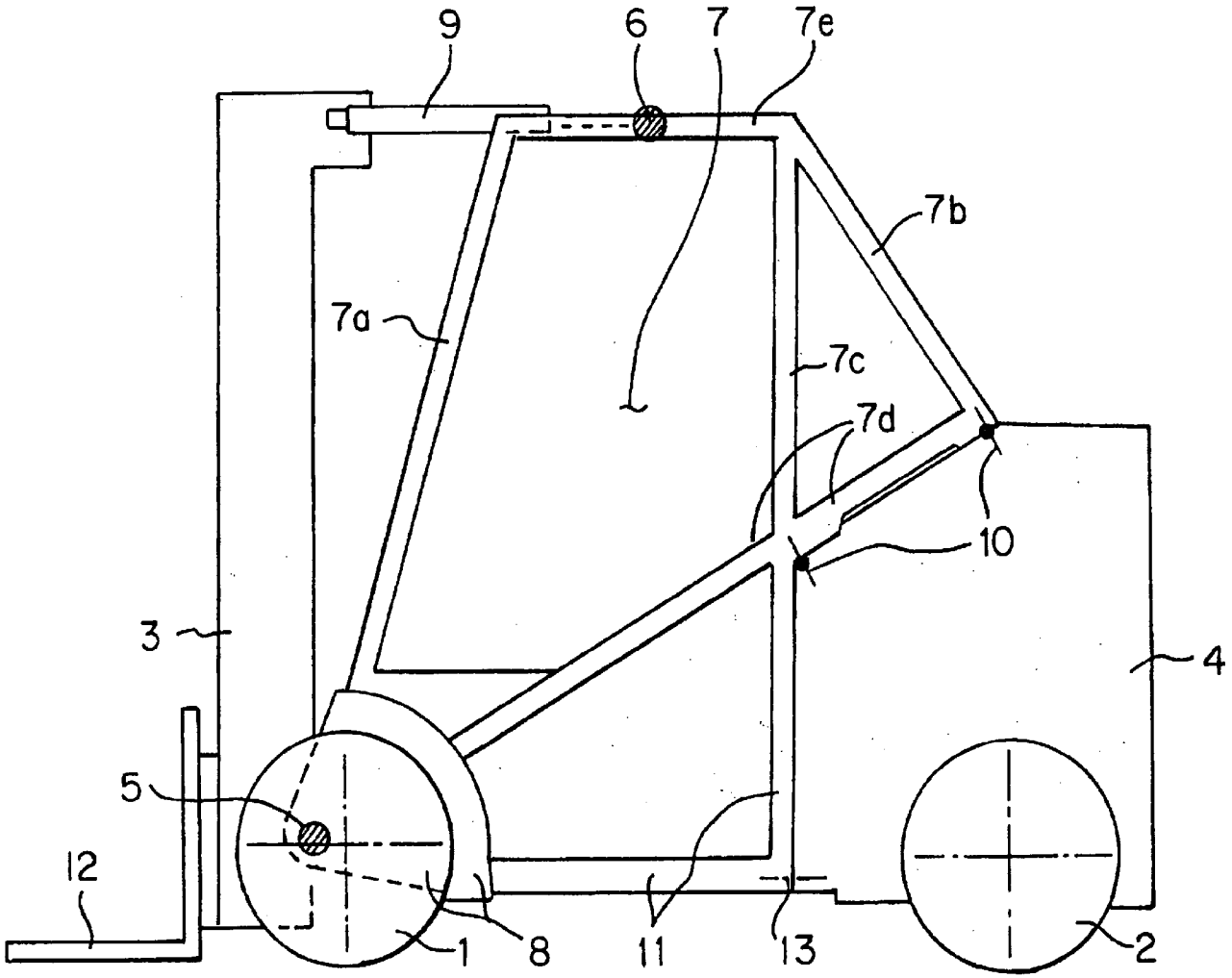
FIG. 1 is a side view of a fork lift truck incorporating features of the invention.

FIG. 1 shows a fork lift truck of the invention. The fork lift truck stands on a roadway with two front wheels 1 and two rear wheels 2. The front wheels 1 are in the vicinity of a lifting frame 3 and the rear wheels 2 are in the vicinity of a rear weight 4. The lifting frame 3 is connected at two bearings 5, 6 to a driver's cab 7, which comprises a plurality of struts 7*a, b, c, d, e* formed of hollow sections connected together to form a framework. The struts 7*a* and 7*d* emerge at their lower ends into a housing 8 of a drive group that contains the lower bearing 5 for the lifting frame 3. Damping elements for the transmission of forces can be located between the housing 8 and the struts 7*a, d*. The upper or top bearing 6 for the lifting frame 3 is connected with a strut 7*e* that extends horizontally, wherein there is a hydraulic cylinder 9 between this top bearing 6 and the lifting frame 3. By means of this hydraulic cylinder 9, the lifting frame 3 can be inclined around an axis that runs through the lower bearing 5 in the transverse direction of the fork lift truck.

In FIG. 1, the bearings 5, 6 are shown as individual points. Actually, the bearings 5, 6 extend in the transverse direction of the fork lift truck and can each be formed by two rocker bearings, for example. Likewise, in this exemplary embodiment, there are two hydraulic cylinders 9 oriented substantially parallel to each other and offset in the transverse direction of the fork lift truck.

A strut 7*d* runs from the housing 8 of the drive group to a bearing 10 for the rear weight 4. The bearing 10 is realized in the form of a rigid connection, e.g., as a bolted connection, and transmits the forces transmitted via the strut 7*d* to the rear weight 4. Above the bearing 10 for the rear weight, there are two additional struts 7*b*, 7*c* which, together with the strut 7*d*, form a triangle. By means of this triangle and the bearing 10 for the rear weight 4, the forces transmitted via the top bearing 6 for the lifting frame 3 are also transmitted into the rear weight 4. As a result of the supported width of the bearing 10, both forces and moments can be transmitted.

The transmission of the forces that originate from the lifting frame during normal operation of the fork lift truck therefore takes place partly via the driver's cab 7. While the vertically acting weight of a load is supported via the front wheels 1 directly on the road surface, torsion forces, for example, are absorbed around a vertical axis and torques around a horizontal axis by the driver's cab 7. A frame corner piece 11 located underneath the driver's cab 7 is connected with the driver's cab 7 and the housing 8 of the drive group, and is used to provide additional reinforcement of the fork lift truck. In particular, horizontal impact forces on a load receptacle device 12 fastened to the lifting frame are transmitted by this frame corner piece 11 into the rear weight 4. For this purpose, the frame corner piece 11 is bolted to the rear weight 4 at the bearing 13.

Figure 2:
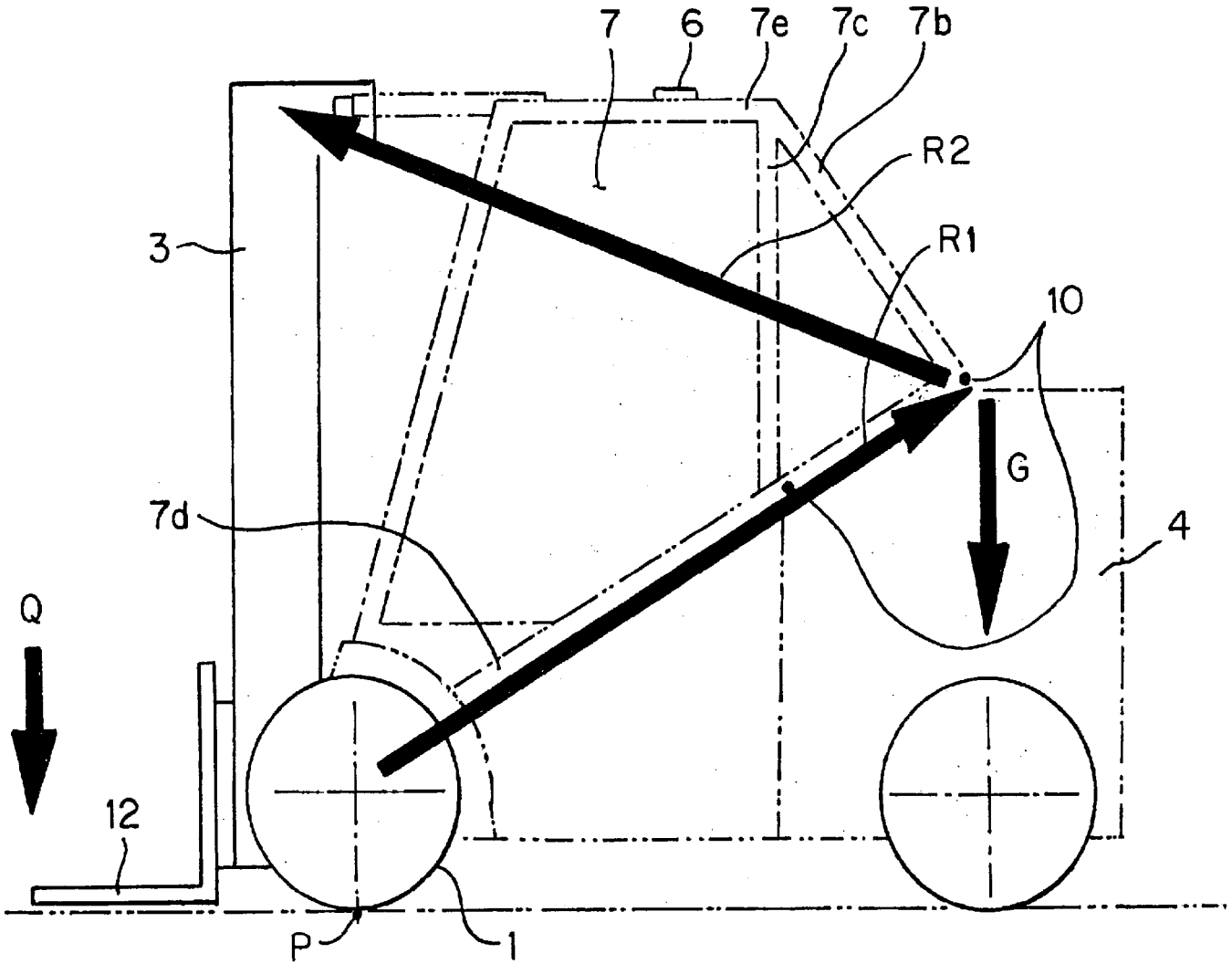
FIG. 2 indicates the flow of forces in the driver's cab of the fork lift truck of FIG. 1.

FIG. 2 is a schematic illustration of the flow of forces through the driver's cab 7 of the fork lift truck during normal operation, in which the load forces are supported primarily by the driver's cab 7. The weight Q of the load lifted using the load receptacle device 12 generates a torque around the contact point P of the front wheel 1. This torque is compensated by a moment transmitted via the driver's cab 7, the resultants R1, R2 of which are indicated by arrows. The resultant R1 is transmitted as a compression force directly via the continuous strut 7*d*. The resultant R2 on the other hand is composed of tension forces in the hydraulic cylinder 9 and the strut 7*e*, a tension force in the strut 7*b* and a compression force in the strut 7*c*. The forces transmitted via the struts 7*b, c, d* are supported at the bearing 10 on the rear weight 4, whereby the weight G of the rear weight 4 acts as a counter-force.

Figure 3:
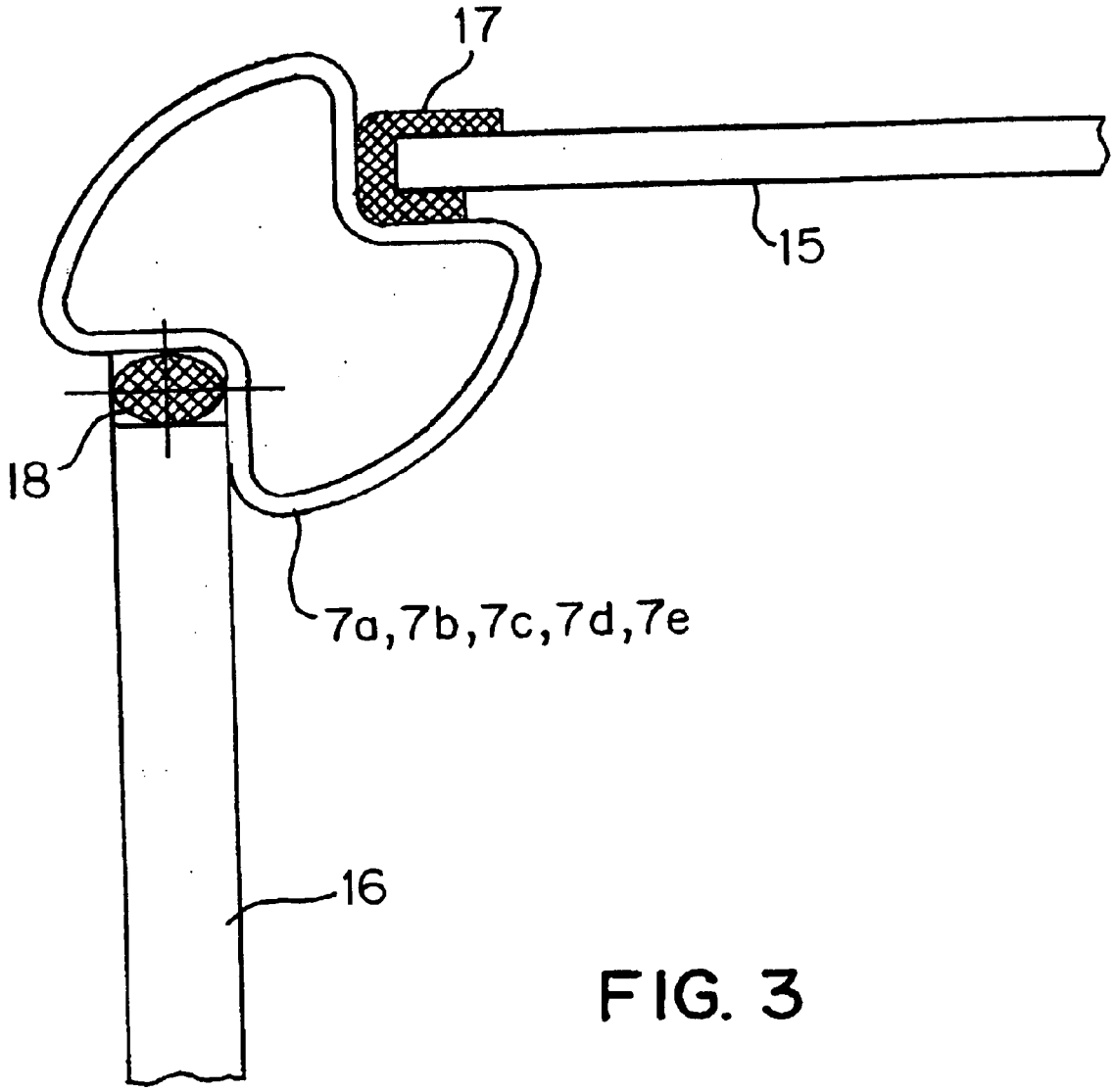
FIG. 3 is a partial cross section of the struts of a driver's cab of the invention.

FIG. 3 shows a cross section of the struts 7*a, b, c, d, e* of the driver's cab 7. The struts 7*a, b, c, d, e* are realized in the form of hollow sections, and in this embodiment have convex and concave segments. The concave segments can be used as seal surfaces for a window 15 or a door 16 of the driver's cab 7. Rubber gaskets 17, 18 for the window 15 or for the door 16 can thereby be made to conform to the concave segments of the struts 7*a, b, c, d, e*.

In this realization of the hollow sections, the struts 7*a, b, c, d, e* achieve the required strength and rigidity for the transmission of the forces from the lifting frame 3.

It will readily be appreciated by those skilled in the art that modifications may be made to the invention without departing from the concepts disclosed in the foregoing description. Such modifications are to be considered as included within the scope of the invention. Accordingly, the particular embodiments described in detail hereinabove are illustrative only and are not limiting as to the scope of the invention, which is to be given the full breadth of the appended claims and any and all equivalents thereof.

What is claimed is:

1. A fork lift truck, comprising:

a lifting frame;

a rear weight;

a driver's cab, wherein the driver's cab forms a load-bearing component of the fork lift truck;

at least two bearings for the lifting frame at a distance from each other, by which the lifting frame is connected with the driver's cab in a force-transmitting connection; and at least one bearing for the rear weight, by means of which the rear weight is connected in a force-transmitting connection with the driver's cab, wherein the bearing for the rear weight is configured to transmit forces and moments, wherein the rear weight is rigidly connected with the driver's cab, wherein the driver's cab has a framework construction, by means of which forces are transmitted between a top bearing for the lifting frame and the bearing for the rear weight, and wherein the framework construction forms a triangle, wherein a first corner of the triangle is located at an upper portion of the driver's cab and a second and third corner of the triangle are located in the vicinity of the bearing for the rear weight.

* * * * *